US009232866B1

(12) United States Patent
Hix et al.

(10) Patent No.: US 9,232,866 B1
(45) Date of Patent: Jan. 12, 2016

(54) CRIB AND MATTRESS RUNNER SYSTEM

(71) Applicants: Anna Hix, Frankfort, IL (US); Thomas Hix, Frankfort, IL (US)

(72) Inventors: Anna Hix, Frankfort, IL (US); Thomas Hix, Frankfort, IL (US)

( * ) Notice: Subject to any disclaimer, the term of this patent is extended or adjusted under 35 U.S.C. 154(b) by 25 days.

(21) Appl. No.: 14/738,902

(22) Filed: Jun. 14, 2015

Related U.S. Application Data

(60) Provisional application No. 62/013,934, filed on Jun. 18, 2014.

(51) Int. Cl.

| | |
|---|---|
| ***A47G 9/02*** | (2006.01) |
| ***A47G 9/04*** | (2006.01) |
| ***A47D 9/00*** | (2006.01) |
| *A47D 13/08* | (2006.01) |
| *A47D 15/00* | (2006.01) |

(52) U.S. Cl.
CPC ..... *A47G 9/0246* (2013.01); *A47D 9/00* (2013.01); *A47G 9/04* (2013.01); *A47D 13/08* (2013.01); *A47D 15/008* (2013.01); *A47G 9/0238* (2013.01)

(58) Field of Classification Search
CPC ..... A47G 6/0246; A47G 9/04; A47G 9/0238; A47G 9/02; A47G 9/0207; A47G 9/0223; A47G 9/083; A47D 9/00; A47D 7/00; A47D 13/08; A47D 13/083; A47D 15/00; A47D 15/001; A47D 15/003; A47D 15/005; A47D 15/008; A47D 15/02
See application file for complete search history.

(56) References Cited

U.S. PATENT DOCUMENTS

| | | | | |
|---|---|---|---|---|
| 2,450,923 | A | 10/1948 | Spiro, Jr. | |
| 2,931,084 | A * | 4/1960 | De Witt | 24/72.5 |
| 4,199,830 | A | 4/1980 | Ogata | |
| D436,489 | S * | 1/2001 | Farrugia | D6/607 |
| 7,673,354 | B2 * | 3/2010 | Fader | 5/494 |
| 8,359,687 | B2 * | 1/2013 | Marlowe | 5/655 |
| 8,566,983 | B2 * | 10/2013 | Monaco | 5/498 |
| 2005/0028278 | A1 | 2/2005 | Landry | |

* cited by examiner

*Primary Examiner* — David E Sosnowski

(57) ABSTRACT

A crib liner or runner made of a soft blanket that is secured in place over a crib mattress's fitted sheet via an easily applied fastener. Design intent is to provide parents of infant and toddler children a practical way in which to "change" their child's bedding in the event it is soiled with formula, drool or other bodily wastes, without requiring them to change the fitted sheet in order to do so. Modified versions of the crib & mattress runner could also be made available for use with children and adult bedding.

19 Claims, 5 Drawing Sheets

CRIB AND MATTRESS RUNNER SYSTEM

CROSS-REFERENCE TO RELATED APPLICATION

The present application is related to and claims priority from prior provisional application Ser. No. 62/013,934, filed Jun. 18, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of runner and liner devices and more specifically relates to a crib and mattress runner system.

2. Description of the Related Art

A child's nursery is perhaps the most precious and vital room in a family's home. Filled with cuddly stuffed animals, stacks of fresh diapers, baby lotions and sweet smelling powders, an infant's nursery provides the new addition with a space all their own. Perhaps the most important element of any nursery is the furnishings. A large dresser filled with tiny clothing and accessories, a comfortable rocking chair where parents can sit for hours gently holding their child and a changing table loaded with supplies, are but a few of the furniture items that make a nursery complete. While all of these items are important for a functioning nursery, by far, the most necessary of all furnishings is a crib. Comprised of an elevated mattress surrounded by four, railed walls, an infant crib is a comfortable bed which protects the child from falling or rolling off their mattress during rest. Most parents apply bedding to their child's crib that is similar to that which is used on beds geared for adults. As such, fitted crib sheets are a necessary item that provide a soft and barrier between the infant and the actual mattress.

Unfortunately, because crib mattresses are typically surrounded by four, raised railings, applying fitted sheets can be a time consuming and challenging endeavor. Lifting the mattress up off the crib frame while wedging the fitted sheet between the mattress and the railing can be a difficult task. Because of this, as long as the fitted sheet is clean, most parents feel comfortable leaving it in place atop the mattress for several days between changing. Not surprisingly however, most conscientious parents recognize that soiled sheets are unsanitary for the infant and thus if the child spills their bottle during the night, drools on the sheet or experiences a leaky diaper, there is no other choice but to change the bedding. As can be imagined, dealing with the hassle of changing a soiled fitted sheet at three o'clock in the morning, while trying to simultaneously comfort a crying infant can be a difficult endeavor at best, rendering both the parent and child frazzled and exhausted. This is not desirable.

Various attempts have been made to solve problems found in liner and runner device art. Among these are found in: U.S. Pat. No. 4,199,830 to Yoshie Ogata; U.S. Pub. No. 2005/0028278 to Jo-Ann Landry; and U.S. Pat. No. 2,450,923 to Edward H. Spiro, Jr. This prior art is representative of liner and runner devices. None of the above inventions and patents, taken either singly or in combination, is seen to describe the invention as claimed.

Ideally, a crib and mattress runner system should be user-friendly and safe in-use and, yet may operate reliably and be manufactured at a modest expense. Thus, a need exists for crib and mattress runner system which is structured and arranged to be removably-coupled to a top sheet covering a mattress inside of a crib and is removable when the crib and mattress runner becomes soiled with formula, fluids and waste matter during a course of an infant sleeping and to avoid the above mentioned problems.

BRIEF SUMMARY OF THE INVENTION

In view of the foregoing disadvantages inherent in the known liner and runner device art, the present invention provides a crib and mattress runner system (entitled 'Crib & Mattress Runner System'). The general purpose of the present invention, which will be described subsequently in greater detail is to provide a crib and mattress runner system that is structured and arranged to be removably-coupled to a top sheet covering a mattress.

A crib and mattress runner system in a preferred embodiment is disclosed herein comprising: a crib and mattress runner assembly having a flat sheet including a top surface, a bottom surface, a first side having at least one first slit and at least one first strap inserted through the first slit having a first-mated-male-and-mated-female-fastener-member, at least one second slit and at least one second strap inserted through the second slit having a second-mated-male-and-mated-female fastener-member; a second side; a third side having at least one third slit and at least one third strap inserted through the third slit having a third-mated-male-and-mated-female-fastener-member, at least one fourth slit, and at least one fourth strap inserted through the fourth slit having a fourth-mated-male-and-mated-female-fastener-member; a fourth side; a horizontal stabilizing strap connector member having a first end and a second end; a first vertical end strap coupled to the first end of horizontal stabilizing strap connector member for connecting the first strap and the second strap together in a uniform arrangement; and a second vertical end strap coupled to the second end of horizontal stabilizing strap connector member for connecting the third strap and the fourth strap together in a uniform arrangement.

The crib and mattress runner system comprises the crib and mattress runner assembly. The crib and mattress runner assembly comprises the flat sheet, the horizontal stabilizing strap connector member, the first vertical end strap coupled, and the second vertical end strap coupled in functional combination. The crib and mattress runner assembly is structured and arranged to be removably-coupled to a top sheet covering a mattress inside of a crib. The top surface, the bottom surface, the first side, the second side, the third side, and the fourth side define the flat sheet.

The crib and mattress runner assembly is rectangular in shape thereby accommodating various sized mattresses for use by the infant. The crib and mattress runner assembly is approximately 32 inches in length by approximately 30-inches in width thereby dimensioned to fit over the mattress. The crib and mattress runner assembly comprises double-stitched and reinforced cushiony soft cotton material. The crib and mattress runner assembly is re-useable and machine washable when the crib and mattress runner assembly becomes soiled. The crib and mattress runner assembly is removable when the crib and mattress runner assembly becomes soiled with formula, fluids and waste matter during a course of the infant sleeping.

The first slit, the second slit, the third slit, and the fourth slit are approximately f-inch in length thereby suitably dimensioned to accommodate the first strap, the second strap, the third strap, and the fourth strap, respectively. The first slit, the second slit, the third slit, and the fourth slit are reinforced for longevity. The first strap, the second strap, the third strap, and the fourth strap comprise reinforced nylon for strength, durability and flexibility when inserting the first strap through the first slit, the second strap through the second slit, the third strap through the third slit, and the four strap through the fourth slit.

The first strap is approximately 7-inches in length by ¾-inch in width thereby dimensioned to fit through the first slit. The second strap is approximately 7-inches in length by ¾-inch in width thereby dimensioned to fit through the second slit. The third strap is approximately 7-inches in length by ¾-inch in width thereby dimensioned to fit through the third slit. The fourth strap is approximately 7-inches in length by ¾-inch in width thereby dimensioned to fit through the fourth slit.

The first-mated-male-and-mated-female-fastener-member, the second-mated-male-and-mated-female-fastener member, the third-mated-male-and-mated-female-fastener-member, and the fourth-mated-male-and-mated-female-fastener-member are used to removably-secure the crib and mattress runner assembly to the mattress to prevent unwanted displacement while in an in-use condition. The first-mated-male-and-mated-female-fastener-member, the second-mated-male-and-mated female-fastener member, the third-mated-male-and-mated-female-fastener-member, and the fourth-mated-male-and-mated-female-fastener-member comprise a hook and loop fastener system. The first-mated-male fastener member, the second-mated-male fastener member, the third-mated-male fastener member, and the fourth-mated-male fastener member comprise hooks while the first-mated-female fastener member, the second-mated-female fastener member, the third-mated-female fastener member, and the fourth-mated-female fastener member comprise loops thereby forming the hook and loop fastener system when the first strap, the second strap, the third strap, and the fourth strap are inserted through the first slit, the second slit, the third slit, and the fourth slit respectively and folded over thereby mating the hook and the loop portion together.

The horizontal stabilizing strap connector member is coupled to the first vertical end strap and the second vertical end strap thereby forming an I-shaped configuration. The horizontal stabilizing strap connector member is approximately 30-inches in length by approximately one-inch in width for added stability and strength integrity thereby preventing unwanted displacement of the crib and mattress runner assembly while in the in-use condition.

The first vertical end strap for connecting the first strap and the second strap forms a first U-shaped configuration when assembled together. The second vertical end strap for connecting the third strap and the fourth strap forms a second U-shaped configuration when assembled together. The first vertical end strap and the second vertical end strap are approximately two-inches in length by ½-inch in width when coupled to the horizontal stabilizing strap connector member thereby forming the I-shaped configuration.

A kit is also embodied herein for the crib and mattress runner system comprising a plurality of crib and mattress runner assemblies in various colors and designs; and a set of user-installation instructions.

A method of using a crib and mattress runner system is disclosed herein comprising the steps of: applying a fitted top sheet onto a mattress located inside of a crib; choosing a crib and mattress runner assembly in a user-preferred color and design; lifting up the mattress; inserting the horizontal stabilizing strap connector member underneath the mattress; placing the mattress back down; laying flat the flat sheet over the fitted top sheet; inserting a first strap through a first slit; pulling the first strap through the first slit to a user-preferred tightness; folding over the first strap thereby mating a first-mated-male-and-mated-female-fastener-member together thereby securing the crib and mattress runner assembly in place; inserting a second strap through a second slit; pulling the second strap through the second slit to a user-preferred tightness; folding over the second strap thereby mating a second-mated-male-and-mated-female-fastener-member together thereby securing the crib and mattress runner assembly in place; inserting a third strap through a third slit; pulling the third strap through the third slit to a user-preferred tightness; folding over the third strap thereby mating a third-mated-male-and-mated-female-fastener-member together thereby securing the crib and mattress runner assembly in place; inserting a fourth strap through a fourth slit; pulling the fourth strap through the fourth slit to a user-preferred tightness; folding over the fourth strap thereby mating a fourth-mated-male-and-mated-female-fastener-member together thereby securing the crib and mattress runner assembly in place; placing an infant on the crib and mattress runner assembly to sleep; removing the infant once sleep is complete; unfastening the first strap, the second strap, the third strap, and the fourth strap; removing the crib and mattress runner assembly from the mattress once soiled; and washing the crib and mattress runner assembly for future use.

The present invention holds significant improvements and serves as a crib and mattress runner system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention crib and mattress runner system (entitled Crib & Mattress Runner System) constructed and operative according to the teachings of the present invention.

The various embodiments of the present invention will hereinafter be described in conjunction with the appended drawings, wherein like designations denote like elements.

DETAILED DESCRIPTION

Figure 1:
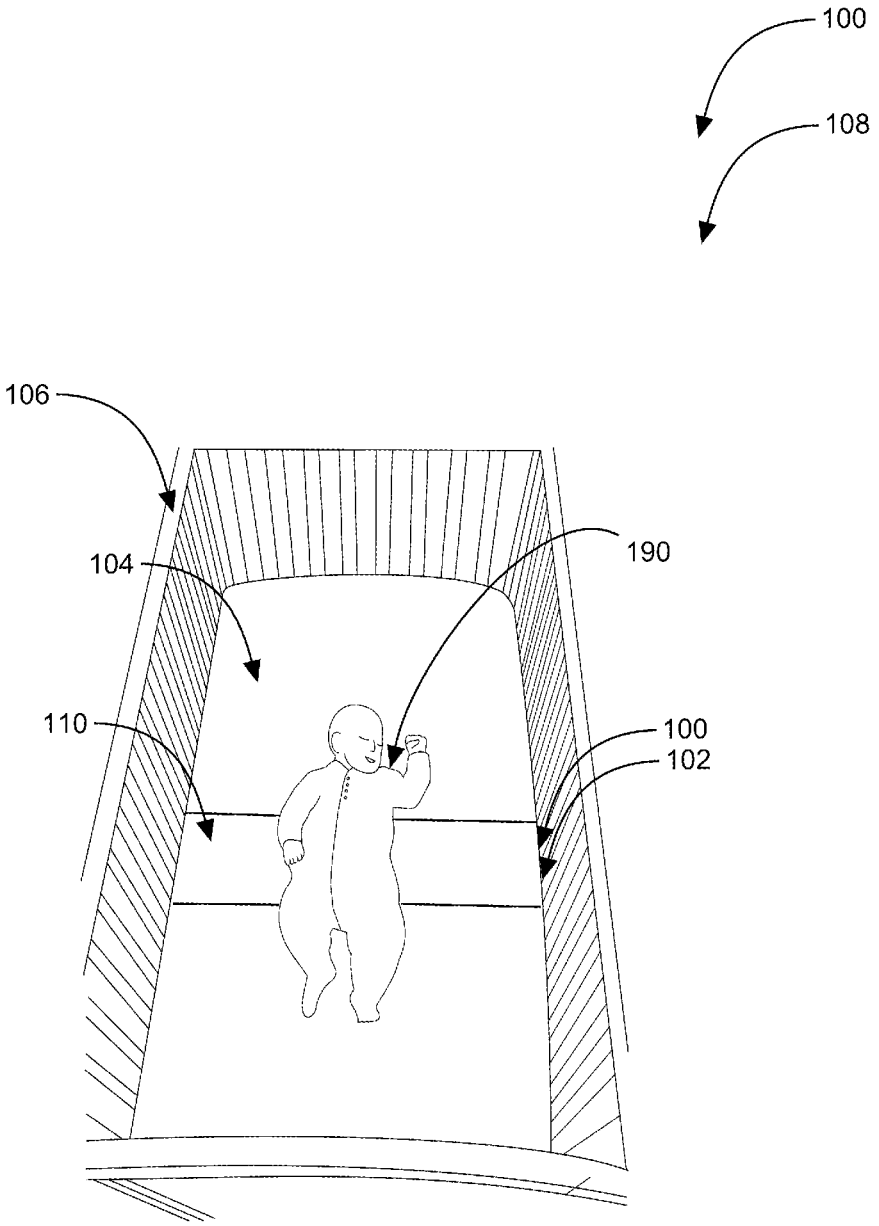
FIG. 1 shows a front perspective view illustrating a crib and mattress runner system in an 'in-use' condition according to an embodiment of the present invention.

As discussed above, embodiments of the present invention relate to a liner and runner device and more particularly to a crib and mattress runner system (entitled Crib & Mattress Runner System) that is structured and arranged to be removably-coupled to a top sheet covering a mattress inside of a crib and is removable when the crib and mattress runner becomes soiled with formula, fluids and waste matter during a course of an infant sleeping.

Generally speaking, the Crib & Mattress Runner System is a specially designed liner, or "runner" to be easily applied in virtually any crib over an existing top sheet, with the device easily changed if the runner become soiled with formula, fluids or waste matter during the course of the child's slumber. Configured to offer a sensible alternative to the arduous task of changing the entire fitted crib sheet, the Crib & Mattress Runner System may be comprised of two main components: the runner itself and a specially designed fastener for use in safely securing the runner in place.

Taken separately, the Crib & Mattress Runner System may be a rectangular shaped panel configured expressly to encompass the majority of a standard crib mattress. As such, this soft runner may measure 30 inches in width by 32 inches in length. Double stitched and reinforced, this runner may be comprised of a cushiony soft cotton material and may be offered in a variety of charming colors and printed designs. Notably, positioned at the outer ends of the head and foot of the runner respectively may be a set of two, slotted openings, each measuring one inch in length and configured to correspond with the previously mentioned fastener system.

Designed to be installed between the underside of the mattress and the framework, the ends of this fastener may extend up and over the sides of the mattress, where they may be connected to the actual runner. The material that comprises this fastener may be a reinforced nylon, canvas or comparable belting, similar to that used in the manufacture of pet leashes. This unique fastener may be comprised of a length of belting measuring 30 inches in length by one inch in width, on either end of which a second set of belting, each featuring a set of sturdy strap fasteners, is perpendicularly attached.

Two support straps, each measuring ½ of an inch in width by 2 inches in length may be positioned on either end of the primary belting, at its juncture with the perpendicular strap. The perpendicular straps may measure slightly smaller than the approximate width of the runner, with the attached, heavy duty strap fasteners each measuring 7 inches in length and ¾ of an inch in width. These straps may be positioned on either end of the perpendicular belting, running parallel with the primary belting and thus creating a "U" configuration. Notably, these straps may be configured specifically to be inserted through the slotted openings located on either end of the runner. Importantly, encompassing the surface of these fasteners may be a series of self-affixing hook and loop closures (more commonly referred to as VELCRO®), configured expressly for use in securing the fasteners to the Crib & Mattress Runner System itself.

A single Crib & Mattress Runner System may be included for sale with each fastener, while additional runners may be sold separately. Because the safety and well-being of the child is of utmost concern, this product should be manufactured in accordance to the stringent guidelines for children's products as set forth by the Juvenile Products Manufacturer's Association (JPMA). Versions of the Crib & Mattress Runner System for use on standard size bedding may also be made available and may provide ideal for use in home health care and extended care settings.

Application and use of the Crib & Mattress Runner System may be very simple and straight forward. Prior to installation of the device, the user may apply a fitted top sheet to their child's crib mattress. The caregiver may then lift the mattress, placing the Crib & Mattress Runner System beneath the mattress and directly atop the crib's support framework. The user may install the fastener so that the primary belting ran widthwise beneath the mattress and was centrally positioned, with perpendicular belting that is attached to either end of the primary belting running lengthwise along the underside of the head and foot of the mattress, respectively. Thus installed, the two sets of two, strap fasteners may hang outside from beneath of the mattress, on either front or back of the crib.

The user may then set the mattress back down atop the installed fastener. The user may then spread the actual Crib & Mattress Runner System flat over the top of the crib mattress, so that it was centrally positioned and encompassed the majority of the mattress. The user may then simply secure the runner in place via the two sets of two strap fasteners that are suspended from beneath the mattress on the front and back of the bed. Lifting a single strap fastener upwards, the user may wrap the fastener up and over the end of the mattress, sliding the end of the strap through the corresponding slotted opening located on the end of the runner and then securing the fastener in place via the heavy duty VELCRO® that encompasses the surface of the unit. This process may then be repeated with the remaining three fasteners. Thus applied, the Crib & Mattress Runner System may be put to immediate use, with the user simply laying their child directly atop the runner when putting them in their crib for the evening or an afternoon nap. Should the child spit up, drool or otherwise soil their bedding, the parent need only remove the Crib & Mattress Runner System by releasing the strap fasteners that secure it in place and installing a fresh and clean runner in its stead. The soiled runner may then be laundered and stored away until again needed.

The Crib & Mattress Runner System is a practical product invention which may offer parents of infant children a number of significant benefits and advantages. Foremost, the Crib & Mattress Runner System may provide parents a practical means of changing soiled linens in a crib, without requiring them to change the actual fitted sheet in order to do so. A cushiony soft and easily applied runner that encompasses the surface of the mattress, the Crib & Mattress Runner System may provide a soft and reliable barrier between the runner and the fitted top sheet positioned directly below. In this manner, should the child drool, spit up, spill their bottle or wet or soil the bed, the caregiver need only replace the runner, as opposed to the entire fitted sheet and bedding.

Sparing the caregiver the time consuming and arduous task of changing a fitted sheet every time the sheet is slightly soiled, use of this uniquely designed product may make the task of providing a child clean and sanitary bedding a quick and easy endeavor. Although especially well-suited for use in household cribs, the Crib & Mattress Runner System may also be utilized by child care providers, in day care centers and similar professional facilities. Further, as the Crib & Mattress Runner System may be offered in versions for use on standard mattresses, this product may prove ideal for use in home health care settings and in long term care facilities. Specifically, the Crib & Mattress Runner System may prove invaluable for use in households where special needs children are present, as well as in hospitals, nursing homes and the like. Machine washable, the Crib & Mattress Runner System may be easily laundered and maintained when not in use. Durably constructed, this bedding system should withstand repeated use with ease. The Crib & Mattress Runner System is a unique product concept which may offer parents of infant children a quick and easy means of changing their child's bedding. Simple in design and practical in function, this handy product may be easily applied to virtually any mattress in a manner of minutes.

Referring now to the drawings by numerals of reference there is shown in FIGS. 1-4 perspective views illustrating crib and mattress runner assembly 102 of crib and mattress runner system 100 according to an embodiment of the present invention.

Crib and mattress runner system 100 comprises: crib and mattress runner assembly 102 having flat sheet 110 including top surface 114, bottom surface 118, first side 120 having at least one first slit 126 and at least one first strap 130 inserted through first slit 126 having first-mated-male-and-mated-female-fastener-member 134, at least one second slit 140 and at least one second strap 142 inserted through second slit 140 having second-mated-male-and-mated-female fastener-member 144; second side 148; third side 150 having at least one third slit 154 and at least one third strap 158 inserted through third slit 154 having third-mated-male-and-mated-female-fastener-member 164, at least one fourth slit 170, and at least one fourth strap 174 inserted through fourth slit 170 having fourth-mated-male-and-mated-female-fastener-member 178; fourth side 184; horizontal stabilizing strap connector member 200 having first end 210 and second end 220; first vertical end strap 230 coupled to first end 210 of horizontal stabilizing strap connector member 200 for connecting first strap 130 and second strap 142 together in a uniform arrangement; and second vertical end strap 240 coupled to second end 220 of horizontal stabilizing strap connector member 200 for connecting third strap 158 and fourth strap 174 together in a uniform arrangement.

Crib and mattress runner system 100 comprises crib and mattress runner assembly 102. Crib and mattress runner assembly 102 comprises flat sheet 110, horizontal stabilizing strap connector member 200, first vertical end strap 230 coupled, and second vertical end strap 240 coupled in functional combination. Crib and mattress runner assembly 102 is structured and arranged to be removably-coupled to top sheet 104 covering a mattress inside of crib 106 as shown in in-use condition 108 of FIG. 1. Top surface 114, bottom surface 118, first side 120, second side 148, third side 150, and fourth side 184 define flat sheet 110.

Crib and mattress runner assembly 102 is preferably rectangular in shape thereby accommodating various sized said mattresses for use by infant 190. Crib and mattress runner assembly 102 is approximately 32 inches in length by approximately 30-inches in width thereby dimensioned to fit over the mattress. Crib and mattress runner assembly 102 comprises double-stitched and reinforced cushiony soft cotton material. Crib and mattress runner assembly 102 is reuseable and machine washable when crib and mattress runner assembly 102 becomes soiled. Crib and mattress runner assembly is removable when crib and mattress runner assembly 102 becomes soiled with formula, fluids and waste matter during a course of infant 190 sleeping.

First slit 126, second slit 140, third slit 154, and fourth slit 170 are approximately 1-inch in length thereby suitably dimensioned to accommodate first strap 130, second strap 144, third strap 158, and fourth strap 174, respectively. First slit 126, second slit 140, third slit 154, and fourth slit 170 are reinforced for longevity. First strap 130, second strap 142, third strap 158, and fourth strap 174 comprise reinforced nylon for strength, durability and flexibility when inserting first strap 130 through first slit 126, second strap 142 through second slit 140, third strap 158 through third slit 154, and four strap 174 through fourth slit 170. Upon reading this specification, it should be appreciated that, under appropriate circumstances, considering such issues as user preferences, design preference, structural requirements, marketing preferences, cost, available materials, technological advances, etc., other material arrangements such as, for example, reinforced canvas, leather, etc., may be sufficient.

First strap 130 is approximately 7-inches in length by ¾-inch in width thereby dimensioned to fit through first slit 126. Second strap 142 is approximately 7-inches in length by ¾-inch in width thereby dimensioned to fit through second slit 140. Third strap 158 is approximately 7-inches in length by ¾-inch in width thereby dimensioned to fit through third slit 154. Fourth strap 174 is approximately 7-inches in length by ¾-inch in width thereby dimensioned to fit through fourth slit 170.

First-mated-male-and-mated-female-fastener-member 134, second-mated-male-and-mated-female-fastener member 144, third-mated-male-and-mated-female-fastener-member 164, and fourth-mated-male-and-mated-female-fastener-member 178 are used to removably-secure crib and mattress runner assembly 102 to the mattress to prevent unwanted displacement while in in-use condition 108. First-mated-male-and-mated-female-fastener-member 134, second-mated-male-and-mated-female-fastener member 144, third-mated-male-and-mated-female-fastener-member 164, and fourth-mated-male-and-mated-female-fastener-member 178 comprise a hook and loop fastener system. First-mated-male fastener member 136, second-mated-male fastener member 145, third-mated-male fastener member 166, and fourth-mated-male fastener member 180 comprise hooks while first-mated-female fastener member 138, second-mated-female fastener member 146, third-mated-female fastener member 168, and fourth-mated-female fastener member 182 comprise loops thereby forming the hook and loop fastener system when first strap 130, second strap 142, third strap 158, and fourth strap 174 are inserted through first slit 126, second slit 140, third slit 154, and fourth slit 170 respectively and folded over thereby mating the hook and the loop portion together.

Figure 4:
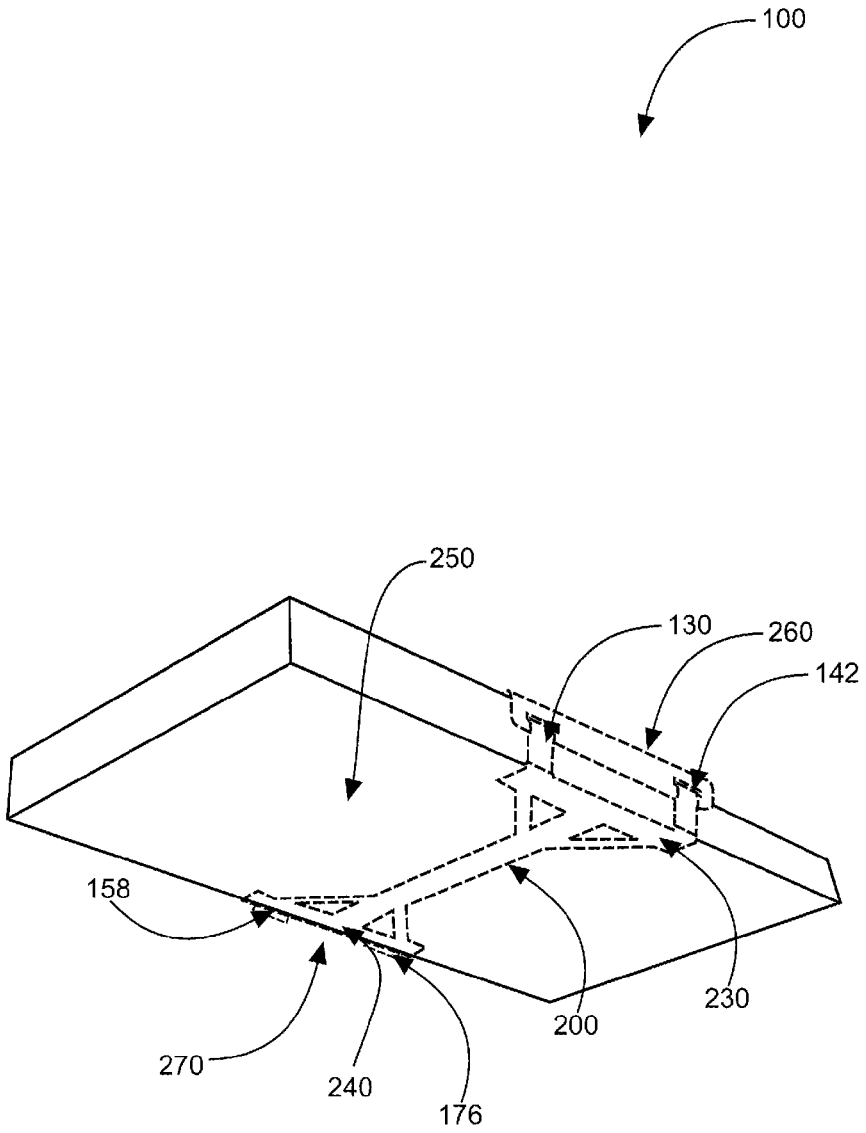
FIG. 4 is a bottom perspective view illustrating a crib and mattress runner assembly of the Crib & Mattress Runner System according to an embodiment of the present invention.

Horizontal stabilizing strap connector member 200 is coupled to first vertical end strap 230 and second vertical end strap 240 thereby forming an I-shaped configuration 250 as shown best in FIG. 4. Horizontal stabilizing strap connector member 200 is approximately 30-inches in length by approximately one-inch in width for added stability and strength integrity thereby preventing unwanted displacement of crib and mattress runner assembly 102 while in in-use condition 106.

First vertical end strap 230 for connecting first strap 130 and second strap 142 forms a first U-shaped configuration

Figure 2:
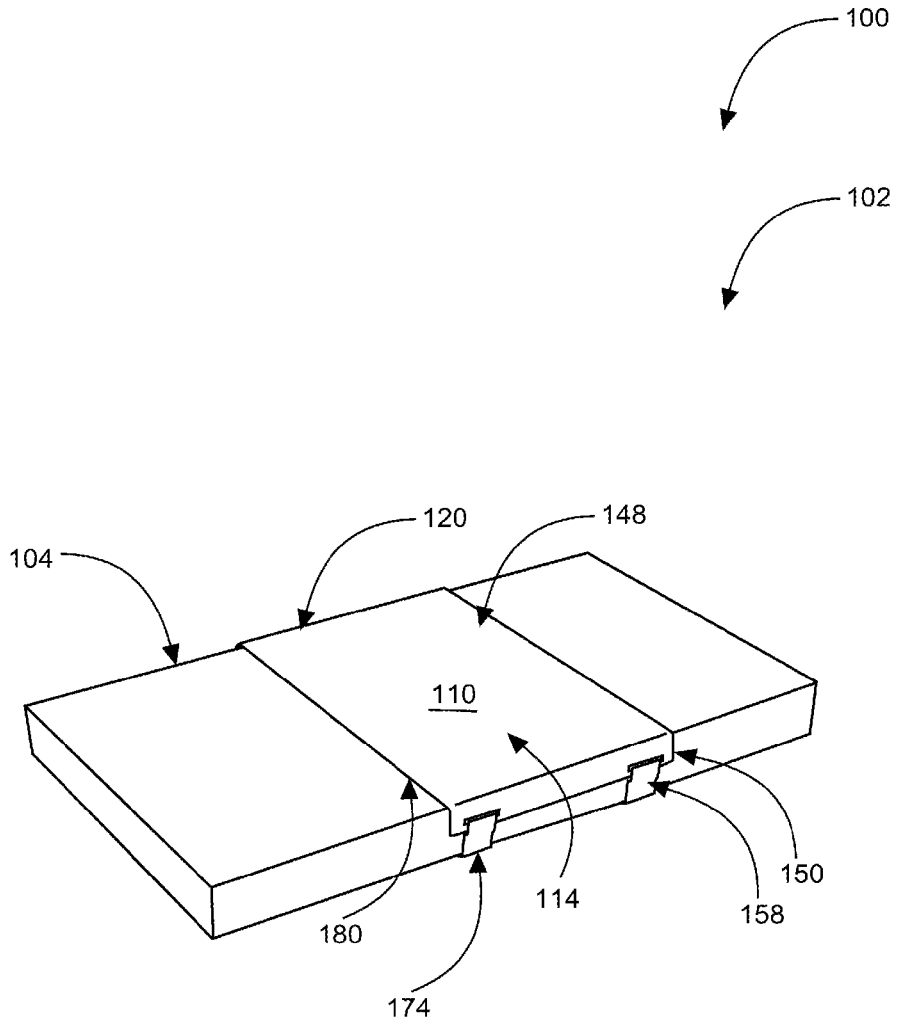
FIG. 2 shows a front perspective view illustrating a crib and mattress runner assembly of the Crib & Mattress Runner System according to an embodiment of the present invention.
Figure 3:
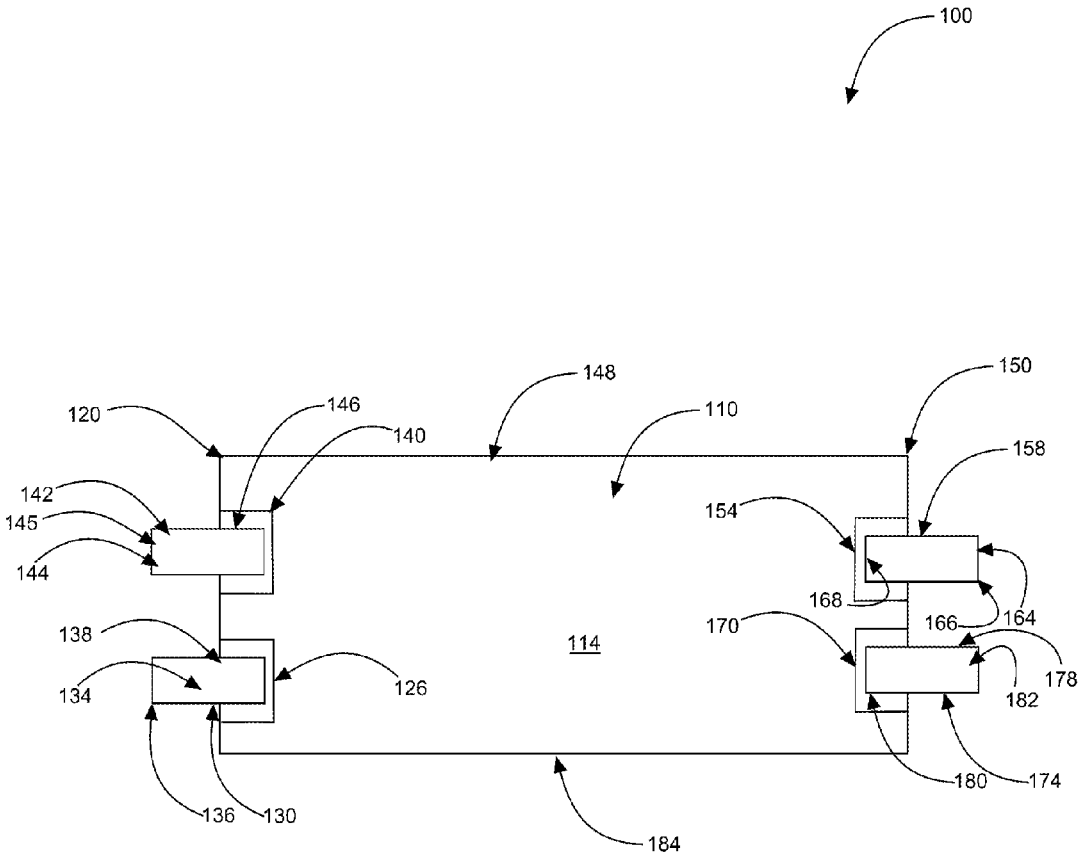
FIG. 3 is a top perspective view illustrating a crib and mattress runner assembly of the Crib & Mattress Runner System according to an embodiment of the present invention.

260 when assembled together as shown best in FIGS. 2 and 4. Second vertical end strap 240 for connecting third strap 158 and fourth strap 174 forms second U-shaped configuration 270 when assembled together also shown best in FIGS. 2 and 4. First vertical end strap 230 and second vertical end strap 240 are approximately two-inches in length by ½-inch in width when coupled to horizontal stabilizing strap connector member 250 thereby forming the I-shaped configuration as shown in FIG. 4.

Crib and mattress runner system 100 may be sold as a kit (not shown) comprising the following parts: plurality of crib and mattress runner assemblies 102 in various colors and designs; and a set of user-installation instructions. The kit has instructions such that functional relationships are detailed in relation to the structure of the invention (such that the invention can be used, maintained, or the like in a preferred manner). Crib and mattress runner system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastener combinations, parts may be sold separately, etc., may be sufficient.

Figure 5:
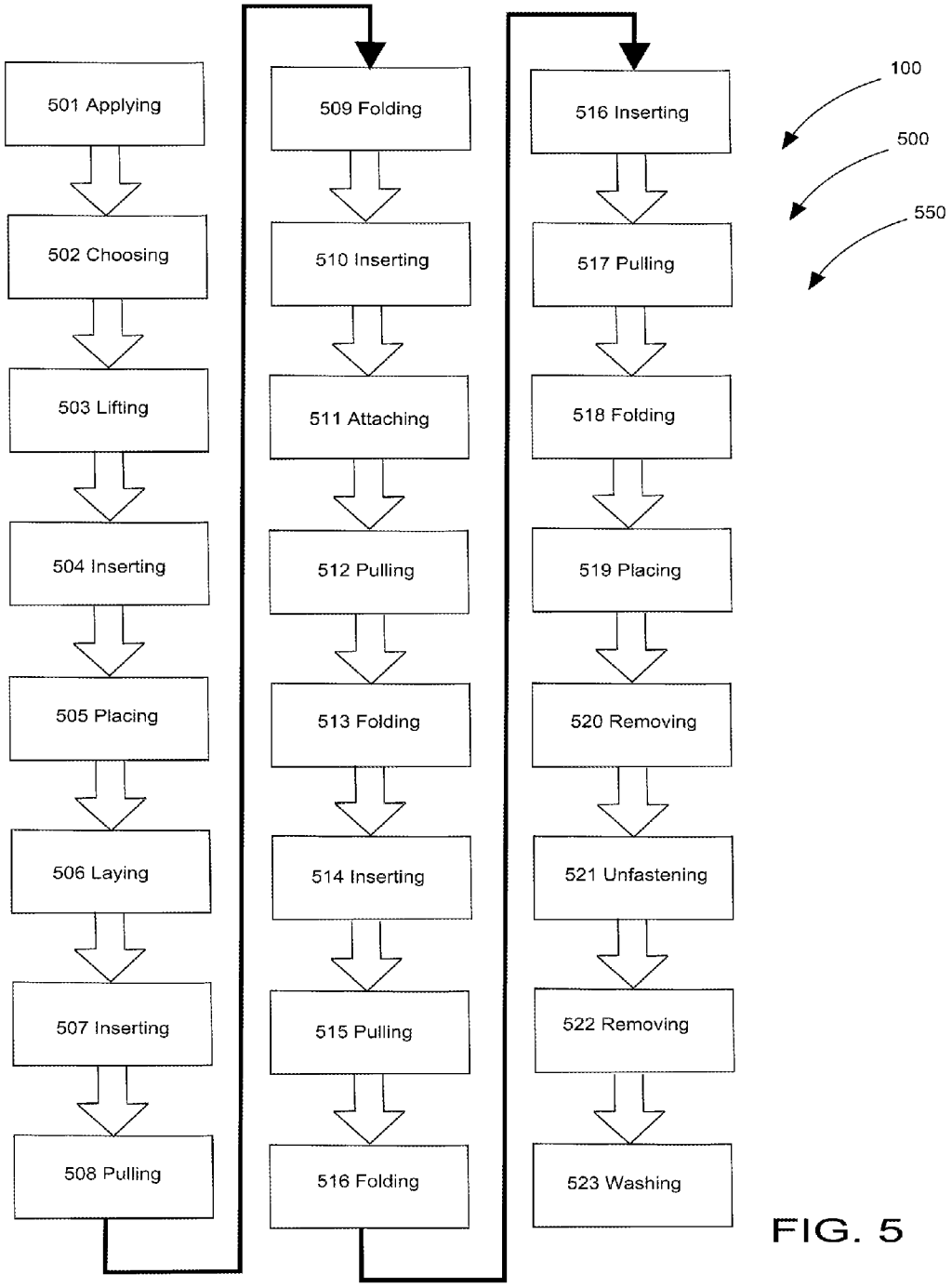
FIG. 5 is a flowchart illustrating a method of use for the Crib & Mattress Runner System according to an embodiment of the present invention of FIGS. 1-4.

Referring now to FIG. 5, flowchart 550 illustrating method of use 500 for crib and mattress runner system 100 according to an embodiment of the present invention of FIGS. 1-4.

Method of using crib and mattress runner system 100 comprises the steps of: step one 501 applying fitted top sheet 104 onto a mattress located inside of crib 106; step two 502 choosing crib and mattress runner assembly 102 in a user-preferred color and design; step three 503 lifting up the mattress; step four 504 inserting horizontal stabilizing strap connector member 200 underneath the mattress; step five 505 placing the mattress back down; step six 506 laying flat sheet 110 over fitted top sheet 104; step seven 507 inserting first strap 130 through first slit 126; step eight 508 pulling first strap 130 through first slit 126 to a user-preferred tightness; step nine 509 folding over first strap 130 thereby mating first-mated-male-and-mated-female-fastener-member 134 together thereby securing crib and mattress runner assembly 102 in place; step ten 510 inserting second strap 142 through second slit 140; step eleven 511 pulling second strap 142 through second slit 140 to a user-preferred tightness; step twelve 512 folding over second strap 142 thereby mating second-mated-male-and-mated-female-fastener-member 144 together thereby securing crib and mattress runner assembly 102 in place; step thirteen 513 inserting third strap 158 through third slit 154; step fourteen 514 pulling third strap 158 through third slit 154 to a user-preferred tightness; step fifteen 515 folding over third strap 158 thereby mating third-mated-male-and-mated-female-fastener-member 164 together thereby securing crib and mattress runner assembly 102 in place; step sixteen 516 inserting fourth strap 174 through fourth slit 170; step seventeen 517 pulling fourth strap 174 through fourth slit 170 to a user-preferred tightness; step eighteen 518 folding over fourth strap 174 thereby mating fourth-mated-male-and-mated-female-fastener-member 178 together thereby securing crib and mattress runner assembly 102 in place; step nineteen 519 placing infant 190 on crib and mattress runner assembly 102 to sleep; step twenty 520 removing infant 190 once sleep is complete; step twenty-one 521 unfastening first strap 130, second strap 142, third strap 158, and fourth strap 174; step twenty-two 522 removing crib and mattress runner assembly 102 from the mattress once soiled; step twenty-three 523 and washing crib and mattress runner assembly 102 for future use.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A crib and mattress runner system comprising:
- a crib and mattress runner assembly having,
  - a flat sheet including,
    - a top surface,
    - a bottom surface,
    - a first side having,
      - at least one first slit,
      - at least one first strap inserted through said at least one first slit having a first-mated male-and-mated-female-fastener-member;
      - at least one second slit, and
      - at least one second strap inserted through said at least one second slit having a second-mated-male-and-mated-female-fastener-member;
    - a second side,
    - a third side having,
      - at least one third slit,
      - at least one third strap inserted through said at least one third slit having a third-mated-male-and-mated-female-fastener-member;
      - at least one fourth slit, and
      - at least one fourth strap inserted through said at least one fourth slit having a fourth-mated-male-and-mated-female-fastener-member; and
    - a fourth side;
  - a horizontal stabilizing strap connector member having a first end and a second end;
  - a first vertical end strap coupled to said first end of horizontal stabilizing strap connector member for connecting said at least one first strap and said at least one second strap together in a uniform arrangement; and
  - a second vertical end strap coupled to said second end of said horizontal stabilizing strap connector member for connecting said at least one third strap and said at least one fourth strap together in a uniform arrangement;

wherein said crib and mattress runner system comprises said crib and mattress runner assembly;

wherein said crib and mattress runner assembly comprises said flat sheet, said horizontal stabilizing strap connector member, said first vertical end strap coupled, and said second vertical end strap coupled in functional combination;

wherein said crib and mattress runner assembly is structured and arranged to be removably-coupled to a top sheet covering a mattress inside of a crib;

wherein said top surface, said bottom surface, said first side, said second side, said third side, and said fourth side define said flat sheet;

wherein said first-mated-male-and-mated-female-fastener-member, said second-mated-male-and-mated-female-fastener member, said third-mated-male-and-mated-female-fastener-member, and said fourth-mated-male-and-mated-female-fastener-member are used to removably-secure said crib and mattress runner assembly to said mattress to prevent unwanted displacement while in an in-use condition;

wherein said horizontal stabilizing strap connector member is coupled to said first vertical end strap and said second vertical end strap thereby forming an I-shaped configuration;

wherein said first vertical end strap for connecting said at least one first strap and said at least one second strap forms a first U-shaped configuration when assembled together;

wherein said second vertical end strap for connecting said at least one third strap and said at least one fourth strap forms a second U-shaped configuration when assembled together; and wherein said crib and mattress runner assembly is removable when said crib and mattress runner assembly becomes soiled with formula, fluids and waste matter during a course of said infant sleeping.

2. The crib and mattress runner system of claim 1 wherein said crib and mattress runner assembly is rectangular in shape thereby accommodating various sized mattresses for use by said infant.

3. The crib and mattress runner system of claim 2 wherein said crib and mattress runner assembly is approximately 32 inches in length by approximately 30-inches in width thereby dimensioned to fit over said mattress.

4. The crib and mattress runner system of claim 3 wherein said crib and mattress runner assembly comprises double-stitched and reinforced cotton material.

5. The crib and mattress runner system of claim 4 wherein said crib and mattress runner assembly is reuseable and machine-washable when said crib and mattress runner assembly becomes soiled.

6. The crib and mattress runner system of claim 4 wherein said at least one first slit, said at least one second slit, said at least one third slit, and said at least one fourth slit are each approximately 1-inch in length thereby suitably dimensioned to accommodate said at least one first strap, said at least one second strap, said at least one third strap, and said at least one fourth strap, respectively.

7. The crib and mattress runner system of claim 6 wherein said at least one first slit, said at least one second slit, said at least one third slit, and said at least one fourth slit are reinforced for longevity.

8. The crib and mattress runner system of claim 1 wherein said at least one first strap, said at least one second strap, said at least one third strap, and said at least one fourth strap comprise reinforced nylon for strength, durability and flexibility when inserting said at least one first strap through said at least one first slit, said at least one second strap through said at least one second slit, said at least one third strap through said at least one third slit, and said at least one four strap through said at least one fourth slit.

9. The crib and mattress runner system of claim 1 wherein said at least one first strap, said at least one second strap, said at least one third strap, and said at least one fourth strap comprise reinforced canvas for strength, durability and flexibility when inserting said at least one first strap through said at least one first slit, said at least one second strap through said at least one second slit, said at least one third strap through said at least one third slit, and said at least one four strap through said at least one fourth slit.

10. The crib and mattress runner system of claim 1 wherein said at least one first strap is approximately 7-inches in length by ¾-inch in width thereby dimensioned to fit through said at least one first slit.

11. The crib and mattress runner system of claim 1 wherein said at least one second strap is approximately 7-inches in length by ¾-inch in width thereby dimensioned to fit through said at least one second slit.

12. The crib and mattress runner system of claim 1 wherein said at least one third strap is approximately 7-inches in length by ¾-inch in width thereby dimensioned to fit through said at least one third slit.

13. The crib and mattress runner system of claim 1 wherein said at least one fourth strap is approximately 7-inches in length by ¾-inch in width thereby dimensioned to fit through said at least one fourth slit.

14. The crib and mattress runner system of claim 1 wherein said first-mated-male-and-mated-female-fastener-member, said second-mated-male-and-mated-female-fastener member, said third-mated-male-and-mated-female-fastener-member, and said fourth-mated-male-and-mated-female-fastener-member comprise a hook and loop fastener system.

15. The crib and mattress runner system of claim 14 wherein said first-mated-male fastener member, said second-mated-male fastener member, said third-mated-male fastener member, and said fourth-mated-male fastener member comprise hooks while said first-mated-female fastener member, said second-mated-female fastener member, said third-mated-female fastener member, and said fourth-mated-female fastener member comprise loops thereby forming said hook and loop fastener system when said at least one first strap, said at least one second strap, said at least one third strap, and said at least one fourth strap are inserted through said at least one first slit, said at least one second slit, said at least one third slit, and said at least one fourth slit respectively and folded over thereby mating said hooks and said loops together.

16. The crib and mattress runner system of claim 1 wherein said horizontal stabilizing strap connector member is approximately 30-inches in length by approximately one-inch in width for added stability and strength integrity thereby preventing unwanted displacement of said crib and mattress runner assembly while in said in-use condition.

17. The crib and mattress runner system of claim 16 wherein said first vertical end strap and said second vertical end strap are each approximately two-inches in length by ½-inch in width when coupled to said horizontal stabilizing strap connector member thereby forming said I-shaped configuration.

18. A crib and mattress runner system comprising:

a crib and mattress runner assembly having, a flat sheet including, a top surface, a bottom surface, a first side having, at least one first slit, at least one first strap inserted through said first at least one slit having a first-mated-male-and-mated-female-fastener-member;

at least one second slit, and at least one second strap inserted through said at least one second slit having a second-mated-male-and-mated-female-fastener-member;

a second side, a third side having, at least one third slit, at least one third strap inserted through said at least one third slit having a third-mated-male-and-mated-female-fastener-member;

at least one fourth slit, and at least one fourth strap inserted through said at least one fourth slit having a fourth-mated-male-and-mated-female-fastener-member;

a fourth side;

a horizontal stabilizing strap connector member having a first end and a second end;

a first vertical end strap coupled to said first end of said horizontal stabilizing strap connector member for connecting said at least one first strap and said at least one second strap together in a uniform arrangement; and a second vertical end strap coupled to said second end of said horizontal stabilizing strap connector member for connecting said at least one third strap and said at least one fourth strap together in a uniform arrangement;

wherein said crib and mattress runner system comprises said crib and mattress runner assembly;

wherein said crib and mattress runner assembly comprises said flat sheet, said horizontal stabilizing strap connector member, said first vertical end strap coupled, and said second vertical end strap coupled in functional combination;

wherein said crib and mattress runner assembly is structured and arranged to be removably-coupled to a top sheet covering a mattress inside of a crib;

wherein said top surface, said bottom surface, said first side, said second side, said third side, and said fourth side define said flat sheet;

wherein said crib and mattress runner assembly is rectangular in shape thereby accommodating various sized mattresses for use by said infant;

wherein said crib and mattress runner assembly is approximately 32 inches in length by approximately 30-inches in width thereby dimensioned to fit over said mattress;

wherein said crib and mattress runner assembly comprises double-stitched and reinforced cotton material;

wherein said crib and mattress runner assembly is reuseable and machine-washable when said crib and mattress runner assembly becomes soiled;

wherein said at least one first slit, said at least one second slit, said at least one third slit, and said at least one fourth slit are each approximately 1-inch in length thereby suitably dimensioned to accommodate said at least one first strap, said at least one second strap, said at least one third strap, and said at least one fourth strap, respectively;

wherein said at least one first slit, said at least one second slit, said at least one third slit, and said at least one fourth slit are reinforced for longevity;

wherein said at least one first strap, said at least one second strap, said at least one third strap, and said at least one fourth strap comprise reinforced nylon for strength, durability and flexibility when inserting said at least one first strap through said at least one first slit, said at least one second strap through said at least one second slit, said at least one third strap through said at least one third slit, and said at least one four strap through at least one said fourth slit;

wherein said at least one first strap is approximately 7-inches in length by ¾-inch in width thereby dimensioned to fit through said at least one first slit;

wherein said at least one second strap is approximately 7-inches in length by ¾-inch in width thereby dimensioned to fit through said at least one second slit;

wherein said at least one third strap is approximately 7-inches in length by ¾-inch in width thereby dimensioned to fit through said at least one third slit;

wherein said at least one fourth strap is approximately 7-inches in length by ¾-inch in width thereby dimensioned to fit through said at least one fourth slit;

wherein said first-mated-male-and-mated-female-fastener-member, said second-mated-male-and-mated-female-fastener member, said third-mated-male-and-mated-female-fastener-member, and said fourth-mated-male-and-mated-female-fastener-member comprise a hook and loop fastener system;

wherein said first-mated-male fastener member, said second-mated-male fastener member, said third-mated-male fastener member, and said fourth-mated-male fastener member comprise hooks while said first-mated-female fastener member, said second-mated-female fastener member, said third-mated-female fastener member, and said fourth-mated-female fastener member comprise loops thereby forming said hook and loop fastener system when said first strap, said second strap, said third strap, and said fourth strap are inserted through said first slit, said second slit, said third slit, and said fourth slit respectively and folded over thereby mating said hooks and said loops together;

wherein said first-mated-male-and-mated-female-fastener-member, said second-mated-male-and-mated-female-fastener member, said third-mated-male-and-mated-female-fastener-member, and said fourth-mated-male-and-mated-female-fastener-member are used to removably-secure said crib and mattress runner assembly to said mattress to prevent unwanted displacement while in an in-use condition;

wherein said horizontal stabilizing strap connector member is coupled to said first vertical end strap and said second vertical end strap thereby forming an I-shaped configuration;

wherein said horizontal stabilizing strap connector member is approximately 30-inches in length by approximately one-inch in width for added stability and strength integrity thereby preventing unwanted displacement of said crib and mattress runner assembly while in said in-use condition;

wherein said first vertical end strap for connecting said at least one first strap and said at least one second strap forms a first U-shaped configuration when assembled together;

wherein said second vertical end strap for connecting said at least one third strap and said at least one fourth strap forms a second U-shaped configuration when assembled together;

wherein said first vertical end strap and said second vertical end strap are each approximately two-inches in length by ½-inch in width when coupled to said horizontal stabilizing strap connector member thereby forming said I-shaped configuration; and wherein said crib and mattress runner assembly is removable when said crib and mattress runner assembly becomes soiled with formula, fluids and waste matter during a course of said infant sleeping.

19. The crib and mattress runner system of claim 18 further comprising a kit including: a plurality of said crib and mattress runner assemblies in various colors and designs; and a set of user-installation instructions.

* * * * *